US008785097B2

(12) United States Patent
Aoki et al.

(10) Patent No.: US 8,785,097 B2
(45) Date of Patent: Jul. 22, 2014

(54) ERASABLE TONER AND PROCESS FOR PRODUCTION THEREOF

(75) Inventors: Takayasu Aoki, Shizuoka-ken (JP); Motonari Udo, Shizuoka-ken (JP); Tsuyoshi Itou, Shizuoka-ken (JP); Masahiro Ikuta, Shizuoka-ken (JP); Takafumi Hara, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/537,426

(22) Filed: Jun. 29, 2012

(65) Prior Publication Data

US 2013/0011776 A1 Jan. 10, 2013

(30) Foreign Application Priority Data

Jul. 8, 2011 (JP) ..... 2011-151354

(51) Int. Cl.
*G03G 9/00* (2006.01)
*G03G 9/09* (2006.01)

(52) U.S. Cl.
USPC ..... 430/109.1; 430/108.1; 430/109.2; 430/109.3; 430/110.2; 430/137.1; 430/134.11; 430/134.14; 430/137.12

(58) Field of Classification Search
USPC ..... 430/108.1, 110.2, 109.1, 109.2, 109.3, 430/137.1, 137.11, 134.14, 137.12
See application file for complete search history.

(56) References Cited

U.S. PATENT DOCUMENTS

| | | | | |
|---|---|---|---|---|
| 5,849,456 | A | 12/1998 | Matsumura et al. | |
| 7,147,981 | B2 * | 12/2006 | Fujikawa et al. | 430/109.2 |
| 2010/0209839 | A1 * | 8/2010 | Kabai et al. | 430/110.2 |

OTHER PUBLICATIONS

Machine Translation of JP2009-294476, Dec. 17, 2009.*

* cited by examiner

*Primary Examiner* — Thorl Chea
(74) *Attorney, Agent, or Firm* — Amin, Turocy & Watson, LLP

(57) ABSTRACT

Disclosed is a decolorable toner produced by aggregating dispersed fine particles of a color material containing at least a color-forming compound, a color-developing agent and a decoloring agent with dispersed fine particles containing at least a binder resin having a carboxyl group, then adding a compound having a carbodiimide group or an epoxy group reactive with the carboxyl group of the binder resin, and thereafter fusing the aggregate particles, respectively in an aqueous medium. The thus obtained decolorable toner can suppress the generation of fine powder by the release of erasable color material fine particles from the toner particles.

8 Claims, 4 Drawing Sheets

ERASABLE TONER AND PROCESS FOR PRODUCTION THEREOF

CROSS-REFERENCE TO RELATED APPLICATIONS

This application is based upon and claims the benefit of priority from Japanese Patent Application No. 151354/2011, filed Jul. 8, 2011; the entire contents of which are incorporated herein by reference.

FIELD

Embodiments described herein relate generally to an erasable toner and a process for production thereof.

BACKGROUND

Due to the widespread use of computer, software, and network, it has become possible to accelerate and share information processing. Fundamentally, digitization of information is suited for storage, accumulation, retrieval, etc., of information, whereas a paper medium is suited for display (especially, browsability) and transfer of information. It is therefore a present state that as digitization of information is developed, the consumption of paper is increasing. On the other hand, reduction of energy consumption represented by $CO_2$ emission is an urgent need in various fields. If a paper medium which is used for temporary display or transfer of information can be recycled, a great contribution can be made to the reduction of energy consumption. There is known a method in which a color is developed and erased by heating using a reversible heat-sensitive recording medium. However, in this method, a color-forming composition is present on a recording medium, and therefore, the method has a disadvantage that a common or plain paper medium cannot be used. It is also known that an erasable toner is produced by a pulverization method. However, the erasable toner has a disadvantage that in a process of melt-kneading components, such as a color-forming agent, a color-developing agent and a decoloring agent, the components are reacted with each other, and therefore, the density of a developed color is decreased and also a decoloring reaction rate is decreased. As a production method other than a kneading pulverization method, a production method employing a wet process in which a toner is obtained by aggregating and fusing fine particles of an erasable color material and fine particles of a binder resin, etc., in an aqueous medium is also known. According to this method, it is possible to mix the fine particles of an erasable color material with the binder resin, etc., to effect coalescence without being subjected to mechanical shearing or high thermal history by melt-kneading. However, in this method, it is not easy to completely incorporate color material fine particles in toner particles, and this method has been found to involve a problem that fine particles of the color material released from the toner particles remain in the toner as fine powder to cause an image defect, such as fogging. This tendency is particularly pronounced when the color material fine particles are microencapsulated.

On the other hand, it is also known to crosslink a toner resin using a reactive polymer, so as to mainly improve the fixability, thermal characteristics and mechanical characteristics of a toner.

DETAILED DESCRIPTION

Figure 1:
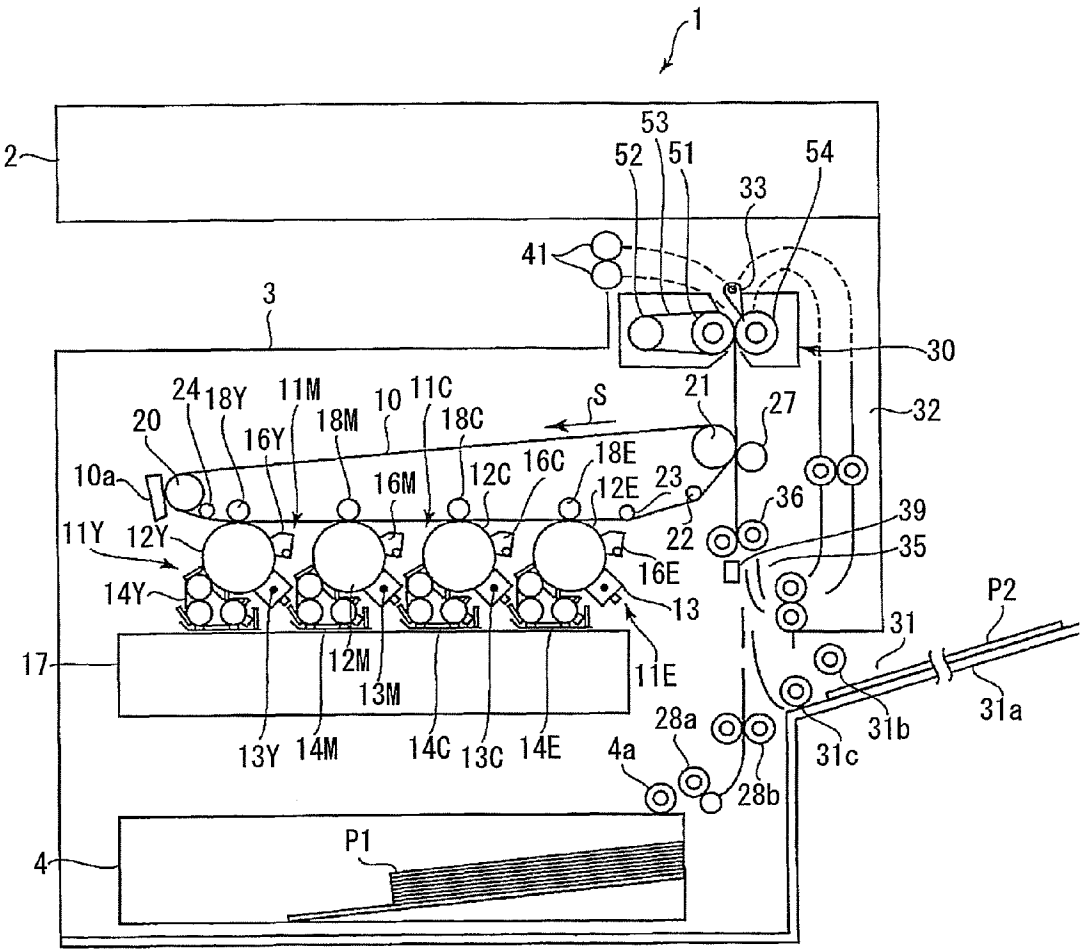
FIG. 1 is an overall arrangement view showing an image forming apparatus to which a developer according to an embodiment is applicable.

Embodiments described herein allow the production of a decolorable toner which suppresses the generation of fine powder due to release of erasable color material fine particles from toner particles.

According to an embodiment, there is provided a decolorable toner, comprising: toner particles comprising at least a binder resin having a carboxyl group, a color-forming compound and a color-developing agent, wherein surfaces of the toner particles have been treated with a compound having a carbodiimide group or an epoxy group reactive with the carboxyl group of the binder resin.

According to another embodiment, there is provided a process for production of a decolorable toner, comprising: aggregating dispersed fine particles of color material comprising at least a color-forming compound, a color-developing agent and a decoloring agent with dispersed fine particles comprising at least a binder resin having a carboxyl group to form aggregate particles, then adding a compound having a carbodiimide group or an epoxy group reactive with the carboxyl group of the binder resin, and thereafter fusing the aggregate particles, respectively in an aqueous medium.

Hereinafter, embodiments will be described in more detail. In the following description, "part(s)" and "%" representing a composition are expressed by weight unless otherwise specified.

(Binder Resin)

As the binder resin to be used in this embodiment, a resin having a carboxyl group reactive with a carbodiimide group or an epoxy group of a reactive compound which will be described later is used. More specific examples thereof include polyester-based resins, styrene-based resins, such as styrene-acrylic copolymers, acrylic resins, phenolic resins, epoxy-based resins, allyl phthalate-based resins, polyamide-based resins, and maleic resins. Among these, a polyester-based resin or a styrene-acrylic copolymer having favorable fixability is preferred.

As the polyester resin, particularly a polyester resin obtained by subjecting a dicarboxylic acid component and a diol component to esterification accompanied with polycondensation is preferred. Examples of the acid component include aromatic dicarboxylic acids, such as terephthalic acid, phthalic acid and isophthalic acid; and aliphatic carboxylic acids, such as fumaric acid, maleic acid, succinic acid, adipic acid, sebacic acid, glutaric acid, pimelic acid, oxalic acid, malonic acid, citraconic acid, and itaconic acid.

Examples of the alcohol component include aliphatic diols, such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols, such as 1,4-cyclohexanediol and 1,4-cyclohexanedimethanol; and ethylene oxide adducts or propylene oxide adducts of bisphenol A, etc.

Further, the above polyester component may be converted so as to have a crosslinked structure by using a trivalent or higher polyvalent carboxylic acid component or a trihydric or higher polyhydric alcohol component, such as 1,2,4-benzenetricarboxylic acid (trimellitic acid) or glycerin. Two or more species of polyester resins having different compositions can be mixed and used. The polyester resin may be crystalline or amorphous.

The glass transition temperature of the polyester resin is preferably 45° C. or higher and 70° C. or lower, and more preferably 50° C. or higher and 65° C. or lower. A polyester resin having a glass transition temperature lower than 45° C. is not preferred because the heat-resistant storage stability of the toner is deteriorated, and further, gloss derived from the resin after erasure becomes noticeable. A polyester resin having a glass transition temperature higher than 70° C. is not preferred because the low-temperature fixability is deteriorated, and also the erasability on heating is poor. From the viewpoint of crosslinkability with a carbodiimide group or an epoxy group and ease of emulsification, a polyester resin having an acid value (JIS K0070) of from 5 to 35 mgKOH/g, particularly from 15 to 35 mgKOH/g is preferred. Further, a polyester resin having a weight-average molecular weight ranging from 6000 to 25000 is preferred. If the weight-average molecular weight thereof is less than 6000, gloss after decoloring is noticeable, and if the weight-average molecular weight thereof exceeds 25000, the fixing temperature is increased, and the density of an image after fixing may be decreased.

Further, in this embodiment, a styrene-acrylic resin obtained by copolymerizing an aromatic vinyl component and a (meth)acrylic acid ester component is also preferably used. Examples of the aromatic vinyl component include styrene, α-methylstyrene, o-methylstyrene, and p-chlorostyrene. Further, a sulfonic acid-based aromatic vinyl component, such as sodium p-styrenesulfonate may be used. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate may generally be used. As, the polymerization method, an emulsion polymerization method may generally be employed, and the resin may be obtained by radical polymerization of monomers of the respective components in an aqueous phase containing an emulsifying agent.

As the styrene-acrylic resin, a styrene-acrylic resin having an acid value of from 30 to 100 mgKOH/g, particularly from 40 to 100 mgKOH/g is preferred. Further, from the viewpoint of prevention of occurrence of gloss after decoloring and persistence of the density of an image after fixing, a styrene-acrylic resin having a weight-average molecular weight ranging from 10000 to 100000 is preferred.

(Color-Forming Compound)

The color-forming compound is an electron-donating precursor of a pigment for use in expressing characters, figures, etc. As an electron-donating color-forming agent, a leuco dye may generally be used. The leuco dye is an electron-donating compound capable of forming a color by the action of the color-developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more species thereof.

(Color-Developing Agent)

The color-developing agent is an electron accepting compound which causes the color-forming agent to develop a color by an interaction with the color-forming compound. Further, the electron accepting color-developing agent has an action to donate a proton to the leuco dye which is the electron-donating color-forming agent, thereby developing a color.

Examples of the color-developing agent include a phenol, a metal salt of a phenol, a metal salt of a carboxylic acid, an aromatic carboxylic acid, an aliphatic carboxylic acid having 2 to 5 carbon atoms, a benzophenone, a sulfonic acid, a sulfonate, phosphoric acid, a metal salt of phosphoric acid, an acidic phosphoric acid ester, a metal salt of an acidic phosphoric acid ester, a phosphorous acid, a metal salt of a phosphorous acid, a monophenol, a polyphenol, 1,2,3-triazole, a derivative thereof, etc.

It is preferred to use the color-developing agent in an amount of from 0.5 to 10 parts, particularly from 1 to 5 parts per part of the leuco dye. If the amount thereof is less than 0.5 part, the density of a developed color is decreased, and if the amount thereof exceeds 10 parts, it becomes difficult to completely erase the color.

(Decoloring Agent)

The decoloring agent to be used in this embodiment, in a three-component system of a leuco dye (a color-forming compound), a color-developing agent and a decoloring agent, may comprise a known compound as long as the compound inhibits the coloring reaction between the leuco dye and the color-developing agent through heating, thereby making a material colorless.

As the decoloring agent, particularly, a decoloring agent which can form a coloring and decoloring mechanism utilizing the temperature hysteresis of a decoloring agent disclosed in JP-A-60-264285, JP-A-2005-1369, JP-A-2008-280523, etc., has an excellent instantaneous erasing property. When a mixture of such a three-component system in a colored state is heated to a specific decoloring temperature Th or higher, the mixture can be decolored. Further, even if the decolored mixture is cooled to a temperature below Th, the decolored state is maintained. When the temperature of the system is further decreased, a coloring reaction between the leuco dye and the color-developing agent is restored at a specific color restoring temperature Tc or lower, and the system returns to a colored state. In this manner, it is possible to cause a reversible coloring and decoloring reaction. In particular, it is preferred that the decoloring agent to be used in this embodiment satisfies the following relation: Th>Tr>Tc, wherein Tr represents room temperature.

Examples of the decoloring agent capable of causing such a temperature hysteresis include alcohols, esters, ketones, ethers, and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These compounds may be used alone or by mixing two or more species thereof.

It is preferred to use the decoloring agent in an amount of from 1 to 500 parts, particularly from 4 to 99 parts per part of the leuco dye. If the amount thereof is less than 1 part, it is not easy to exhibit a completely decolored state, and if the amount thereof exceeds 500 parts, the density of a developed color may be decreased.

According to a preferred embodiment, fine particles (or source particles to be aggregated) of the color material containing the above-described three components of a leuco dye, a color-developing agent and a decoloring agent are used as cores and encapsulated. Examples of an encapsulation method include an interfacial polymerization method, a coacervation method, an in-situ polymerization method, a submerged drying method, and a submerged curing coating method.

In particular, an in-situ polymerization method in which a melamine resin is used as a shell component, an interfacial polymerization method in which a urethane resin is used as a shell component, etc., is preferably used.

In the case of an in-situ polymerization method, first, the above-mentioned three components are dissolved and mixed, and then, the resulting mixture is emulsified in an aqueous solution of a water-soluble polymer or a surfactant. Thereafter, an aqueous solution of a melamine formalin prepolymer is added thereto, followed by heating to effect polymerization, whereby encapsulation can be achieved.

In the case of an interfacial polymerization method, the above-mentioned three components and a polyvalent isocyanate prepolymer are dissolved and mixed, and then, the resulting mixture is emulsified in an aqueous solution of a water-soluble polymer or a surfactant. Thereafter, a polyvalent base, such as a diamine or a diol is added thereto, followed by heating to effect polymerization, whereby encapsulation can be achieved.

In this manner, it is possible to attain an aqueous dispersion liquid of encapsulated color material fine particles having a volume-basis median particle diameter (which is a particle diameter at which a cumulative volume percent counted either from the smaller particle diameter side or the larger particle diameter side in a particle size distribution amounts to 50%) as measured by a laser method (measurement particle diameter rage: 0.01-300 μm) of from 0.5 to 3.5 μm, preferably from 1.0 to 3.0 μm, and having a sharp particle size distribution. As described above, by encapsulating the erasable color material fine particles, the three components of a leuco dye (a color-forming compound), a color-developing agent, and a decoloring agent constituting the color material fine particles are caused to be present in close contact with each other in each capsule, and a binder resin is not interposed therebetween. Accordingly, a coloring-decoloring system which achieves quick conversion between a colored state in which the density is high and a decolored state is formed.

(Release Agent)

In the toner of this embodiment, a release agent can be incorporated as needed. Examples of the release agent include aliphatic hydrocarbon-based waxes, such as low-molecular weight polyethylene, low-molecular weight polypropylene, polyolefin copolymers, polyolefin waxes, paraffin waxes, and Fischer-Tropsch waxes, and modified products thereof; vegetable waxes, such as candelilla wax, carnauba wax, Japan wax, jojoba wax, and rice wax; animal waxes, such as beeswax, lanolin, and spermaceti wax; mineral waxes, such as montan wax, ozokerite, and ceresin; fatty acid amides, such as linoleic acid amide, oleic acid amide, and lauric acid amide; functional synthetic waxes; and silicone-based waxes.

In this embodiment, it is particularly preferred that the release agent has an ester bond between an alcohol component and a carboxylic acid component. Examples of the alcohol component include higher alcohols, and examples of the carboxylic acid component include saturated fatty acids having a linear alkyl group; unsaturated fatty acids, such as monoenoic acid and polyenoic acid; and hydroxy fatty acids. Further examples of the carboxylic acid component include unsaturated polyvalent carboxylic acids, such as maleic acid, fumaric acid, citraconic acid, and itaconic acid. Further, an anhydride thereof can also be used.

From the viewpoint of low-temperature fixability, the release agent may have a softening point of from 50° C. to 120° C., more preferably from 60° C. to 110° C.

According to a preferred embodiment, the release agent is preferably supplied as a mixture with the binder resin in the form of a dispersed fine particles (or source particles to be aggregated) having a volume-based median particle diameter as measured by a laser method (measurement particle diameter rage: 0.01-300 μm) of from 50 to 500 nm, and it is preferred to use the release agent such that the total amount of the binder resin and the release agent to be used as needed may be from 1 to 99 parts, particularly from 2 to 19 parts per part of the dispersion of color material fine particles in the final toner.

(Charge Control Agent)

In this embodiment, in the binder resin, a charge control agent, etc., for controlling a triboelectric chargeability may be blended. As the charge control agent, a metal-containing azo compound may be used, and a complex or a complex salt in which the metal element is iron, cobalt, or chromium, or a mixture thereof is preferred. Further, a metal-containing salicylic acid derivative compound can also be used, and a complex or a complex salt in which the metal element is zirconium, zinc, chromium, or boron, or a mixture thereof is preferred.

Fine particles containing the above-described binder resin, release agent, charge control agent, etc., can be formed by a method described in JP-A-2010-191430, such as a method in which these components are melt-kneaded, and if necessary the melt-kneaded material is coarsely crushed, and thereafter the resulting material is pulverized by ejecting the mixture from a high-pressure pump through a nozzle, or an emulsion polymerization method.

(Reactive Compound Having Carbodiimide Group or Epoxy Group)

As a major component of the toner according to this embodiment, a reactive compound having a carbodiimide group or an epoxy group reactive with the carboxyl group of the binder resin is used. It is necessary to perform the reaction at a temperature not higher than the decoloring temperature, and therefore, a compound which reacts with the carboxyl group at a temperature ranging from normal temperature to about 80° C. is preferred. According to a preferred embodiment, the compound having a carbodiimide group or an epoxy group is added before or after, preferably after, the aggregate particles are formed in an aqueous dispersion medium from the dispersion of color material fine particles and the dispersion of fine particles comprising at least a binder resin composed of a polyester resin, and is subjected to a reaction with the polyester resin. Therefore, the reactive compound is preferably soluble in water.

Such a reactive compound having a carbodiimide group or an epoxy group preferably has an ability to form a film on the aggregated material, and therefore it is not necessary that the reactive compound is a polymer, but the reactive compound may preferably have a molecular weight which is at least nearly equivalent to that of a di- or tri-functional oligomer.

Further, in consideration of the improved confinement of the color material fine particles in the toner particles and the storage stability of the resulting toner, it is preferred to use such a reactive compound having a carbodiimide group or an epoxy group in an amount of from 0.3 to 10.0 parts, particularly from 0.5 to 5.0 parts (based on the effective component of the reactive compound having a carbodiimide group or an epoxy group) per 100 parts of the polyester-based binder resin.

The reactive compound having a carbodiimide group is preferably a polycarbodiimide resin having a carbodiimide equivalent of from about 300 to 800. Examples of commercially available products thereof include SV-02, V-02, V-02-L2, and V-04, all of which are made by Nisshinbo Chemical Inc.

Further, the reactive compound having an epoxy group is preferably a polyhydric alcohol having an epoxy equivalent of from about 100 to 1000. Examples of commercially available products thereof include DENACOL EX313, 314, 421, 512, and 521, all of which are made by Nagase ChemteX Corporation. Such a compound having an epoxy group is subjected to a reaction with the binder resin having a carboxyl group, by itself or together with a substance having an amino group or a hydroxy group (such as an ethylene amine) which may be added in an amount of from 0.1 to 1.0 part per part of the epoxy group-containing compound as another preferred embodiment, whereby a reaction temperature between the reactive compound and the binder resin having a carboxyl group can be lowered.

(Aggregating Agent)

By adding an aggregating agent, the dispersion of color material fine particles, which are preferably encapsulated, and a dispersion of solid fine particles including a dispersion of fine particles containing at least a binder resin having a carboxyl group may be aggregated in an aqueous dispersion medium preferably in the presence of a surfactant. At this time, it is preferred to set a solid content concentration in the aqueous dispersion liquid to 10 to 50%, particularly 20 to 30%. When the aggregating agent is added, it is preferred to add the aggregating agent by adjusting the temperature of the aqueous dispersion liquid to about 20° C. to 50° C.

Preferable examples of the aggregating agent may include: organic aggregating agents, such as cationic surfactants in the form of quaternary salts and polyethyleneimine; inorganic metal salts, inclusive of sodium sulfate, sodium chloride, calcium chloride, calcium nitrate, magnesium chloride, magnesium sulfate, calcium nitrate, zinc chloride, ferric chloride, ferric sulfate, aluminum sulfate, aluminum chloride, and inorganic metal salt polymers such as, poly(aluminum chloride) and poly(aluminum hydroxide); inorganic ammonium salts, such as ammonium sulfate, ammonium chloride and ammonium nitrate; divalent or higher polyvalent metal complexes; etc.

It is preferred to use the aggregating agent in an amount of from 3 to 40 parts, particularly from 5 to 30 parts, per 100 parts of the solid component including the color material fine particles and the binder resin-containing fine particles. If the amount of the aggregating agent is less than 3 parts, an aggregation ability may be insufficient, and if the amount thereof exceeds 40 parts, coarse particles may be generated during aggregation, or the chargeability of the resulting toner may be deteriorated.

(Aggregation)

Aggregation is performed by adding the above-described aggregating agent to the aqueous dispersion liquid containing the dispersion of color material fine particles and the dispersion of fine particles containing the binder resin having a carboxyl group (and the release agent), under stirring, and maintaining the temperature at about 25 to 80° C.

(Reaction and Fusion)

After aggregation of the dispersion of color material fine particles and the dispersion of fine particles containing the binder resin is performed as described above, a reactive compound having a carbodiimide group or an epoxy group is added, and further if necessary, a fusion stabilizing agent such as an aqueous solution of sodium polycarboxylate is added. Thereafter, the temperature is gradually increased to the glass transition temperature of the binder resin to about 90° C., preferably while stirring, whereby a reaction between the carboxyl group of the binder resin and the carbodiimide group or the epoxy group of the reactive compound in the aggregated particles is caused, and fusion of the aggregated particles is accelerated. In order to effectively perform the crosslinking reaction and fusion, it is preferred to maintain the temperature within a range of from 50 to 90° C. for 0.5 to 5 hours. Subsequently, the aggregated and fused particles are washed with water and dried, whereby decolorable toner particles having a volume-based median particle diameter as measured by a Coulter counter method (measurement particle diameter rage: 1.0-30 μm) of 5 to 20 μm, are obtained.

(External Additive)

In this embodiment, in order to adjust the fluidity or chargeability of the toner particles obtained as described above, inorganic fine particles may be mixed with the toner particles to effect external addition in an amount of from 0.01 to 20% based on the amount of the toner particles. As such inorganic fine particles, silica, titania, alumina, strontium titanate, tin oxide, etc., can be used alone or in admixture of two or more types thereof. It is preferred that as the inorganic fine particles, those surface-treated with a hydrophobizing agent are used from the viewpoint of improvement of environmental stability. Further, other than such inorganic oxides, resin fine particles having a size of 1 μm or smaller can be externally added for improving the cleaning property.

EXAMPLES

Hereinafter, embodiments will be more specifically described with reference to Examples and Comparative Examples.

(Production of Amorphous Polyester Resin A)

39 Parts of terephthalic acid, 61 parts of an ethylene oxide adduct of bisphenol A, and 0.2 part of dibutyltin were placed in an esterification reactor, and a polycondensation reaction was performed in a nitrogen atmosphere at 260° C. and 50 KPa (a reduced pressure system) for 5 hours, whereby a polyester resin (acid value: 30 mgKOH/g, molecular weight: 8000) was obtained.

(Production of Polyester-Based Resin Dispersion Liquid A)

94.4 Parts of Amorphous polyester resin A and 5.6 parts of rice wax as a release agent were kneaded using a twin-screw kneader, and the resulting kneaded material was crushed, whereby a coarsely crushed material was obtained. 100 Parts of the obtained coarsely crushed material, 3 parts of an anionic surfactant ("Neogen R", made by Dai-ichi Kogyo Seiyaku Co., Ltd.) as a surfactant, 5 parts of dimethylaminoethanol and 150 parts of deionized water, were placed in a 1 L-stirring vessel provided with a paddle blade, heated to 115° C., and held under stirring for 2 hours at a blade-rotation speed of 200 rpm. Thereafter, the resulting mixture was cooled to room temperature, whereby Resin dispersion liquid A was produced. The volume-basis median particle diameter of the resin dispersion liquid was measured using a laser diffraction particle size distribution analyzer ("SALD-7000", made by Shimadzu Corporation, measurement particle diameter range: 10 nm to 300 μm) and found to be 260 nm.

(Production of Polyester-Based Resin Dispersion Liquid B)

Resin dispersion liquid B was prepared by excluding the rice wax component from the above Resin dispersion liquid A.

(Production of Styrene-Acrylic Copolymer Resin Dispersion Liquid C)

85.0 Parts of styrene, 13.0 parts of n-butyl acrylate, 2.0 parts of acrylic acid, 1.5 parts of tertiary dodecyl mercaptan as a chain transfer agent, and 0.5 part of an emulsifying agent ("LATEMUL PS", made by Kao Corporation as were added, 0.8 part of ammonium persulfate as a polymerization initiator and 200 parts of deionized water were added to perform emulsion polymerization at 60° C., whereby Styrene-acrylic copolymer Resin dispersion liquid C was obtained. The obtained resin had a weight-average molecular weight of 32000 and an acid value of 45 mgKOH/g.

Production of Release Agent Dispersion Liquid D

20 Parts of rice wax (made by NS Chemical Industries) and 1 part of an anionic surfactant (Neopelex G-65, made by Kao Corporation) were mixed with 79 parts of deionized water, and the resulting mixture was processed using a homogenizer (made by IKA Japan K.K.) for 10 minutes under heating, whereby Release agent dispersion liquid D having a volume-basis median particle diameter of 152 nm (determined on the basis of the particle size distribution measured using "SALD-7000" made by Shimadzu Corporation) was obtained.

Example 1

In order to form a color material, 5 parts of Crystal Violet Lactone (CVL) as a leuco dye, 5 parts of benzyl 4-hydroxybenzoate as a color-developing agent and 50 parts of 4-benzyloxyphenylethyl laurate as a discoloration temperature controlling agent (decoloring agent) were melted by heating. The resulting melted materials were poured into 250 parts of an aqueous solution of 8% polyvinyl alcohol together with a solution obtained by mixing 20 parts of an aromatic polyvalent isocyanate prepolymer and 40 parts of ethyl acetate as encapsulating agents, and the resulting mixture was emulsified and dispersed. After stirring was continued at 70° C. for about 1 hour, 2 parts of a water-soluble aliphatic modified amine was added thereto as a reaction agent, and stirring was further continued for about 3 hours while maintaining the temperature of the liquid at 90° C., whereby colorless capsule particles were formed. Further, the resulting dispersion of the capsule particles was placed in a freezer (at −30° C.) to develop a color, whereby a dispersion of blue colored particles was obtained. The volume-basis median particle diameter of the resulting colored particles was measured using "SALD-7000" made by Shimadzu Corporation and found to be 2 μm. Further, the colored particles showed a completely decoloring temperature Th of 79° C. and a completely coloring temperature Tc of −20° C.

The completely decoloring temperature refers to a temperature at which a colored state caused by coupling the color-forming compound to the color-developing agent is converted into a completely decolored state (a state in which the color-forming compound and the color-developing agent are not coupled with each other and therefore coloring due to the coupling is not caused) by heating. Meanwhile, the completely coloring temperature refers to a temperature at which a decolored state is converted into a completely colored state (a state where the image density becomes almost the maximum when using a toner having the composition) by cooling.

100 Parts of the dispersion liquid containing 10 parts of the above encapsulated color material and 300 parts of Toner binder Resin dispersion liquid A (containing 90 parts of the resin component) were mixed with each other, and further 181 parts of an aqueous solution of 11% ammonium sulfate $[(NH_4)_2SO_4]$ was added thereto to effect aggregation, whereby a toner particle dispersion liquid was prepared. Thereafter, the temperature was increased to 50° C. and an aqueous solution of a compound having a carbodiimide group ("SV-02", made by Nisshinbo Chemical Inc., effective component content: 40%) was added thereto so as to provide a ratio of the effective component to the solid component of the toner of 3.6%. Then, 250 parts of 2.5 wt %-aqueous solution of an anionic surfactant ("EMAL E-27C" made by Kao Corporation) was added thereto, and the temperature was increased to 65° C. and maintained for 2 hours, whereby a toner dispersion liquid was prepared. After cooling, the toner particles were collected from the dispersion liquid through de-watering, washing, and drying. The volume-basis median particle diameter of the collected toner particles measured using a Coulter counter (aperture diameter: 50 μm, measurement particle diameter range: 1.0 to 30 μm) was 7.5 μm.

3.5 Parts of hydrophobic silica ("NAX50", made by Japan Aerosil Co., Ltd., average particle diameter: 30 nm) and 0.5 parts of titanium oxide ("NKT90", made by Japan Aerosil Co., Ltd., average particle diameter: 20 nm) were mixed with 100 parts of the obtained toner particles to effect external addition, whereby a toner of Example 1 was obtained.

Example 2

Toner particles were prepared in the same manner as in Example 1 except that the addition amount of the aqueous solution containing a compound having a carbodiimide group ("SV-02" made by Nisshinbo Chemical Inc.) in Example 1 was changed so as to provide a ratio of the effective component to the solid component of the toner of 6.8%. The volume-basis median particle diameter of the toner particles was 7.1 μm. Thereafter, the same external additives as in Example 1 were added to the toner particles, whereby a toner was obtained.

Example 3

Toner particles were prepared in the same manner as in Example 1 except that the addition amount of the aqueous solution containing a compound having a carbodiimide group ("SV-02" made by Nisshinbo Chemical Inc.) in Example 1 was changed so as to provide a ratio of the effective component to the solid component of the toner of 2.5%. The volume-basis median particle diameter of the toner particles was 6.5 μm. Thereafter, the same external additives as in Example 1 were added to the toner particles, whereby a toner was obtained.

Example 4

100 Parts of a dispersion liquid containing 10 parts of an encapsulated color material prepared in the same manner as in Example 1 and 200 parts of the Toner binder Resin dispersion liquid A (containing 60 parts of the resin component) were mixed with each other, and further 164 parts of an aqueous solution of 11% ammonium sulfate [$(NH_4)_2SO_4$] was added thereto to effect aggregation, whereby a core particle dispersion liquid was prepared. Further, 100 parts of Toner binder Resin dispersion liquid B (containing 30 parts of the resin component) for forming a shell was added thereto at 50° C. and the resulting mixture was maintained as such for 3 hours, whereby an encapsulated toner particle dispersion liquid was prepared. Thereafter, an aqueous solution containing a compound having a carbodiimide group ("SV-02" made by Nisshinbo Chemical Inc., effective component content: 40%) was added thereto so as to provide a ratio of the effective component to the solid component of the toner of 1.5%. Then, 250 parts of 2.5 wt %-aqueous solution of an anionic surfactant ("EMAL E-27C" a carbodiimide group or an epoxy group by Kao Corporation) was added thereto, and the temperature was increased to 65° C. and maintained for 2 hours, whereby toner particles were prepared. Thereafter, in the same manner as in Example 1, the toner particles were collected through de-watering, washing, and drying, whereby encapsulated toner particles were obtained. The volume-basis median particle diameter of the thus obtained toner particles measured in the same manner as in Example 1 was 7.2 μm. Thereafter, the same external additives as in Example 1 were added to the toner particles, whereby a toner was obtained.

Example 5

100 Parts of a dispersion liquid containing 10 parts of an encapsulated color material prepared in the same manner as in Example 1, 255 parts of the Styrene-acrylic Resin dispersion liquid C (containing 85 parts of the resin component), and 25 parts of Release agent dispersion liquid D (containing 5 parts of the release agent) were mixed with one another, and further 50 parts of an aqueous solution of 10% aluminum sulfate [$Al_2(SO_4)_3$] was added thereto to effect aggregation, whereby a toner particle dispersion liquid was prepared. Thereafter, the temperature was increased to 50° C. and an aqueous solution containing a compound having a carbodiimide group ("SV-02" made by Nisshinbo Chemical Inc., effective component content: 40%) was added thereto so as to provide a ratio of the effective component to the solid component of the toner of 8.5%. Then, 250 parts of 2.5 wt %-aqueous solution of an anionic surfactant ("EMAL E-27C" made by Kao Corporation) was added thereto, and the temperature was increased to 70° C. and maintained for 2 hours, whereby toner particle dispersion liquid was prepared. After cooling, the toner particles were collected from the dispersion liquid through de-watering, washing, and drying. The volume-basis median particle diameter of the collected toner particles measured using a Coulter counter was 9.4 μm. Thereafter, the same external additives as in Example 1 were added to the toner particles, whereby a toner was obtained.

Example 6

100 Parts of a dispersion liquid containing 10 parts of an encapsulated color material prepared in the same manner as in Example 1 and 300 parts of Toner binder Resin dispersion liquid A (containing 90 parts of the resin component) were mixed with each other, and further 181 parts of an aqueous solution of 11% ammonium sulfate [$(NH_4)_2SO_4$] was added thereto to effect aggregation, whereby a toner particle dispersion liquid was prepared. Then, the temperature was increased to 45° C., and the pH of the toner particle dispersion liquid was adjusted to 7.0 with an aqueous solution of 5 wt % KOH. Subsequently, diethylenetriamine and an epoxy compound ("DENACOL EX313", made by Nagase ChemteX Corporation) were added thereto in amounts of 0.2% and 1.0%, respectively, based on the amount of the solid component of the toner, and the resulting mixture was heated for 5 hours. Thereafter, 250 parts of 2.5 wt %-aqueous solution of an anionic surfactant ("EMAL E-27C" made by Kao Corporation) was added thereto, and the temperature was increased to 65° C. and maintained for 2 hours, whereby a toner particle dispersion liquid was prepared. After cooling, the toner particles were collected from the dispersion liquid through de-watering, washing, and drying. The volume-basis median particle diameter of the collected toner particles measured using a Coulter counter was 6.3%. Thereafter, the same external additives as in Example 1 were added to the toner particles, whereby a toner was obtained.

Example 7

Toner particles were prepared in the same manner as in Example 6 except that the addition amounts of diethylenetriamine and the epoxy compound ("DENACOL EX313", made by Nagase ChemteX Corporation) based on the amount of the solid component of the toner in Example 6 were changed to 0.4% and 2.0%, respectively. The volume-basis median particle diameter of the toner particles was 6.5 μm. Thereafter, the same external additives as in Example 1 were added to the toner particles, whereby a toner was obtained.

Example 8

100 Parts of a dispersion liquid containing 10 parts of an encapsulated color material prepared in the same manner as in Example 1, 255 parts of Styrene-acrylic Resin dispersion liquid C (containing 85 parts of the resin component), and 25 parts of Release agent dispersion liquid D (containing 5 parts of the wax component) were mixed with one another, and further 50 parts of an aqueous solution of 10% aluminum sulfate [$Al_2(SO_4)_3$] was added thereto to effect aggregation, whereby a toner particle dispersion liquid was prepared. Thereafter, the temperature was increased to 45° C. and diethylenetriamine and an epoxy compound ("DENACOL EX313", made by Nagase ChemteX Corporation) were added thereto in amounts of 0.4% and 2.0%, respectively, based on the amount of the solid component of the toner, and the resulting mixture was heated for 5 hours. Thereafter, 250 parts of 2.5 wt % of an anionic surfactant ("EMAL E-27C" made by Kao Corporation) was added thereto, and the temperature was increased to 70° C. and maintained for 2 hours, whereby a toner particle dispersion liquid was prepared. After cooling, the toner particles were collected from the dispersion liquid through de-watering, washing, and drying. The volume-basis median particle diameter of the collected toner particles measured using a Coulter counter was 8.5 μm. Thereafter, the same external additives as in Example 1 were added to the toner particles, whereby a toner was obtained.

Example 9

100 Parts of a dispersion liquid containing 10 parts of an encapsulated color material prepared in the same manner as in Example 1 and 200 parts of Toner binder Resin dispersion liquid A (containing 60 parts of the resin component) were mixed with each other, and further 164 parts of an aqueous solution of 11% ammonium sulfate [$(NH_4)_2SO_4$] was added thereto to effect aggregation, whereby a core particle dispersion liquid was prepared. Further, 100 parts of Toner binder Resin dispersion liquid B (containing 30 parts of the resin component) for forming a shell was added thereto at 50° C. and the resulting mixture was maintained as such for 3 hours, whereby an encapsulated toner particle dispersion liquid was prepared. Thereafter, diethylenetriamine and an epoxy compound ("DENACOL EX313", made by Nagase ChemteX Corporation) were added thereto in amounts of 0.2% and 1.0%, respectively, based on the amount of the solid component of the toner, and the resulting mixture was heated for 5 hours. Then, 250 parts of 2.5 wt % of an anionic surfactant ("EMAL E-27C" made by Kao Corporation) was added thereto, and the temperature was increased to 65° C. and maintained for 2 hours, whereby toner particles were prepared. Thereafter, in the same manner as in Example 1, the toner particles were collected through de-watering, washing, and drying was performed, whereby encapsulated toner particles were obtained. The volume-basis median particle diameter of the thus obtained toner particles measured in the same manner as in Example 1 was 7.0 μm. Thereafter, the same external additives as in Example 1 were added to the toner particles, whereby a toner was obtained.

Example 10

In the same manner as in Example 6, 100 parts of a dispersion liquid containing 10 parts of an encapsulated color material and 300 parts of Toner binder Resin dispersion liquid A (containing 90 parts of the resin component) were mixed with each other, and further 181 parts of an aqueous solution of 11% ammonium sulfate [$(NH_4)_2SO_4$] was added thereto to effect aggregation, whereby a toner particle dispersion liquid was prepared. Then, the temperature was increased to 45° C., and the pH of the toner particle dispersion liquid was adjusted to 7.0 with an aqueous solution of 5 wt % KOH: Subsequently, an epoxy compound ("DENACOL EX313" made by Nagase ChemteX Corporation) was added thereto in an amount of 2.0% based on the amount of the solid component of the toner, and the resulting mixture was heated to 45° C. for 5 hours. Thereafter, 250 parts of 2.5 wt %-aqueous solution of an anionic surfactant ("EMAL E-27C" made by Kao Corporation) was added thereto, and the temperature was increased to 85° C. and maintained for 5 hours, whereby a toner particle dispersion liquid was prepared. After cooling, the toner particles were collected from the dispersion liquid through de-watering, washing, and drying. The volume-basis median particle diameter of the collected toner particles measured using a Coulter counter was 6.8 μm. Thereafter, the same external additives as in Example 1 were added to the toner particles, whereby a toner was obtained.

Comparative Example 1

Toner particles were obtained in the same manner as in Example 1 except that unlike Example 1, a toner particle dispersion liquid was formed by increasing the temperature of the aggregated toner particle dispersion liquid to 65° C. immediately after completion of aggregation without adding the aqueous solution containing a compound having a carbodiimide group to the aggregated toner particle dispersion liquid. The volume-basis median particle diameter of the toner particles measured using a Coulter counter was 6.2 μm. Thereafter, the same external additives as in Example 1 were added to the toner particles, whereby a toner was obtained.

Comparative Example 2

Toner particles were obtained in the same manner as in Example 5 except that unlike Example 5, a toner particle dispersion liquid was formed by increasing the temperature of the aggregated toner particle dispersion liquid to 65° C. immediately after completion of aggregation without adding the aqueous solution containing a compound having a carbodiimide group to the aggregated toner particle dispersion liquid. The volume-basis median particle diameter of the toner particles measured using a Coulter counter was 6.8 μm. Thereafter, the same external additives as in Example 1 were added to the toner particles, whereby a toner was obtained.

The toners obtained in the above Examples and Comparative Examples were evaluated for the following items.

(Toner Fine Powder)

The particle diameter of each toner after being subjected to washing, drying, and external addition was measured using a Coulter particle size analyzer with an aperture diameter of 50 μm (measurement particle diameter range: 1.0 to 30 μm). The value of a cumulative number % in the range of from 1.0 μm to 2.0 μm in the number-basis distribution was adopted as a measure as a measure of toner fine powder content.

(Storage Stability of Toner)

20.0 g of each toner after being subjected to external addition was immersed in hot water at 50° C. for 8 hours, and then shaken for 10 seconds using a "Powder Tester" made by Hosokawa Micron Corporation. Thereafter, the ratio (wt %) of the amount of the aggregated toner remaining on a sieve (42 mesh, opening: 0.351 mm) was measured as an index of the storage stability of the toner.

The outlines of the above Examples and Comparative Examples and the evaluation results are summarized and shown in the following Table 1.

TABLE 1

| Example | Binder resin | Toner encapsulation | Coating agent Type | Coating agent Amount (Wt. %)* | Amine amount (Wt. %)* | Toner Particle size (μm) | Toner Fine powder (%) | Toner Storage stability 42 mesh-on (Wt. %) |
|---|---|---|---|---|---|---|---|---|
| 1 | Polyester | None | Carbodiimide | 3.6 | 0 | 7.5 | 10.2 | 0.60 |
| 2 | Polyester | None | Carbodiimide | 6.8 | 0 | 7.1 | 6.5 | 0.35 |
| 3 | Polyester | None | Carbodiimide | 2.5 | 0 | 6.5 | 12.2 | 0.85 |
| 4 | Polyester | Yes | Carbodiimide | 1.5 | 0 | 7.2 | 5.5 | 0.50 |
| 5 | Styrene acrylic | None | Carbodiimide | 8.5 | 0 | 9.4 | 6.7 | 0.48 |
| 6 | Polyester | None | Epoxy | 1.0 | 0.2 | 6.3 | 12.1 | 0.72 |
| 7 | Polyester | None | Epoxy | 2.0 | 0.4 | 6.5 | 8.5 | 0.51 |
| 8 | Styrene acrylic | None | Epoxy | 2.0 | 0.4 | 8.5 | 9.3 | 0.88 |
| 9 | Polyester | Yes | Epoxy | 1.0 | 0.2 | 7.0 | 6.5 | 0.50 |
| 10 | Polyester | None | Epoxy | 2.0 | 0 | 6.8 | 15.2 | 1.31 |
| Comparative 1 | Polyester | None | None | 0 | 0 | 6.2 | 35.2 | 46.3 |
| Comparative 2 | Styrene acrylic | None | None | 0 | 0 | 6.8 | 45.2 | 28.4 |

*Addition amount of coating agent and amine are each in wt. % to toner particle solid content.

From the results shown in the above Table 1, it is found that by treating toner particles with a reactive compound having a carbodiimide group or an epoxy group, not only the storage stability of a toner was improved, but also the confinement of decolorable toner color material fine particles was significantly improved, although the confinement in a toner was particularly difficult due to the microencapsulation of the core material (Comparative Examples 1 and 2). Further, the generation of toner fine powder was suppressed (Examples 1 to 10). Further, it was found that by encapsulating toner particles with a shell material made mainly of a binder resin prior to the treatment with a reactive compound having a carbodiimide group or an epoxy group, even by the treatment with a small amount of the reactive compound having a carbodiimide group or an epoxy group, the confinement of microencapsulated decolorable toner color material fine particles in a toner was further improved (Examples 4 and 9).

In the toner of the above Examples, the completely decoloring temperature of the color material is 79° C., and it is necessary to perform fixing at a temperature lower than 79° C. The enhancement of the mechanical strength of the toner by crosslinking increases the molecular weight of the resin and also increases the fixing temperature. Therefore, in order to form a toner which can be fixed at a low temperature in a colored state, it is preferred that crosslinking is caused only in a shell region, that is, on a surface of the toner and in a region proximate to the surface thereof without causing a crosslinking reaction in the inside of the toner, that is, in an aggregated material. Accordingly, as in the case of Examples 4 and 9, it is preferred that after forming aggregated particles, the entire surface of each aggregated particle is coated with a thin layer of polyester resin particles, and thereafter causing a crosslinking reaction.

Although depending on the completely erasing temperature of the color material, it is not easy to increase the completely erasing temperature of the color material and to sufficiently increase the difference between the coloring temperature and the erasing temperature due to restrictions on materials. In view of this, it is preferred that the erasing temperature is set to 85 to 120° C., the fixing temperature is set to about 85 to 70° C., and the difference between the erasing temperature and the fixing temperature is set to 10° C. or more. For a toner required to have low-temperature fixability as described above, it is particularly important to perform crosslinking only in a surface region as in the case of Examples 4 and 9.

Each of the toners of Examples 1 to 10 was placed in an MFP ("e-STUDIO 3520c" made by Toshiba Tec Corporation) modified for evaluation, and an unfixed image was formed. Then, in a fixing device (30 mm/s) modified for evaluation, the fixing temperature was set to 75° C. and the erasing temperature was set to 85° C., and fixing and erasing of the toner were performed. As a result, each toner showed sufficient fixability and erasability.

FIG. 1 is a schematic arrangement view showing an overall organization of an image forming apparatus to which a developer according to this embodiment is applicable.

As illustrated, a color image forming apparatus of a four-drum tandem type (MFP) 1 is provided with a scanner section 2 and a paper discharge section 3 at an upper section thereof.

The color image forming apparatus 1 has an image forming unit 11 below an intermediate transfer belt 10. The image forming unit 11 includes four sets of image forming units 11Y, 11M, 11C and 11E arranged in parallel along the intermediate transfer belt 10. The image forming units 11Y, 11M, 11C and 11E form yellow (Y), magenta (M), cyan (C) and decolorable (or erasable) blue (E) toner images, respectively.

The color image forming apparatus 1 has three image forming modes including (1) a mode of forming images using developers selected from three colors Y, M and C, (2) a mode of forming images using developers of Y, M and C and a decolorable toner, and (3) a mode of forming images using only a decolorable toner, and effects image formation by selecting any one of these modes. The evaluation of the fixability of decolorable toners in the above-mentioned Examples, image formation was performed by selecting the mode (3) of forming images using only a decolorable toner and operating only the image forming unit 11E The image forming units 11Y, 11M, 11C and 11E have photosensitive drums 12Y, 12M, 12C and 12E, respectively, as image-bearing members, respectively. Each of the photosensitive drums 12Y, 12M, 12C and 12E rotates in the direction of an arrow m. Around the photosensitive drums 12Y, 12M, 12C and 12E, electric chargers 13Y, 13M, 13C and 13E, developing devices 14Y, 14M, 14C and 14E and photosensitive drum cleaners 16Y, 16M, 16C and 16E, for the respective drums, are disposed along the rotational direction.

Between each of the electric chargers 13Y, 13M, 13C and 13E and each of the developing devices 14Y, 14M, 14C and 14E, the photosensitive drums 12Y, 12M, 12C and 12E, light are irradiated with light from a laser exposing device (latent image forming device) 17 to form electrostatic latent images on the photosensitive drums 12Y, 12M, 12C and 12E.

The developing devices 14Y, 14M, 14C and 14E supply toners on the latent images on the photosensitive drums 12Y, 12M, 12C and 12E.

An intermediate transfer belt 10 is disposed under tension around a backup roller 21, a driven roller 20 and first to third tension rollers 22 to 24 and is rotated in the direction of an arrow S. The intermediate transfer belt 10 faces and is in contact with the photosensitive drums 12Y, 12M, 12C and 12E. At the positions where the intermediate transfer belt 10 faces the photosensitive drums 12Y, 12M, 12C and 12E, primary transfer rollers 18Y, 18M, 18C and 18E are provided, respectively. The primary transfer rollers 18Y, 18M, 18C and 18E are electroconductive rollers and supply primary transfer bias voltages to respective transfer sections.

A secondary transfer roller 27 is disposed to face a secondary transfer section of the intermediate transfer belt 10 supported by the backup roller 21. At the secondary transfer section, a predetermined secondary transfer bias is applied to the backup roller 21 which is an electroconductive roller. When a paper sheet P (P1 or P2) passes between the intermediate transfer belt 10 and the secondary transfer roller 27, the toner image on the intermediate transfer belt 10 is secondarily transferred to the paper sheet P. After the secondary transfer, the intermediate transfer belt 10 is cleaned by a belt cleaner 10*a*.

Below the laser exposure device 17 is disposed a paper feed cassette 4 for supplying paper sheets toward the secondary transfer roller 27. On the right side of the color image forming apparatus 1 is disposed a manual paper feed mechanism for feeding paper sheets manually supplied.

Along the path from the paper feed cassette 4 to the secondary transfer roller 27, a pickup roller 4*a*, a separation roller 28*a* and 28*b*, conveying rollers 28*b* and a resist roller pair 36 are provided to form a paper feed mechanism. Along the path from a manual feed tray 31*a* of the manual feed mechanism 31 to the resist roller pair 36, a manual feed pickup roller 31*b* and a manual feed separation roller 31*c* are provided.

Further, along a vertical conveying path 34 for conveying paper sheets in a direction of from the paper feed cassette 4 or the manual feed tray 31*a* to the secondary transfer roller 27, a media sensor 39 is disposed for detecting the type of fed paper sheets. The color image forming apparatus 1 is composed to be able to control the speed of conveying paper sheets, transfer condition, fixing condition, etc., based on the detection result given by the media sensor 39. Further, a fixing device 30 is provided downstream of the secondary transfer section along the vertical conveying path 34. Paper sheets taken out of the paper feed cassette 4 or supplied from the manual feed mechanism 31 are conveyed along the vertical conveying path 34, through the resist roller pair 36 and the secondary transfer roller 27 to the fixing device 30. The fixing device 30 includes a fixing belt 53 wound about a pair of a heating roller 51 and a drive roller 52, and a mating roller 54 disposed opposite to the heating roller 51 via the fixing belt 53. A paper sheet carrying a toner image transferred at the secondary transfer section is conveyed to between the fixing belt 53 and the mating roller 54 for being heated by the heating roller 51 to fix the toner image onto the paper sheet. Downstream of the fixing device 30, a gate 33 which guides the paper sheet P to either a paper discharge roller 41 or a reconveying unit 32 is provided. A paper sheet P guided to the paper discharge roller 41 is discharged to a paper discharge section 3. A paper sheet P guided to the reconveying unit 32 is guided to the secondary transfer roller 27 again.

The image forming section 11E integrally includes the photosensitive drum 11 and process means and is disposed to be freely attached to and detached from the main assembly of the color image forming apparatus 1. The image forming sections 11*y*, 11M and 11C also have similar structures as the section 11. The color image forming apparatus 1 will be described in more detail with reference to FIGS. 2 to 5.

Figure 2:
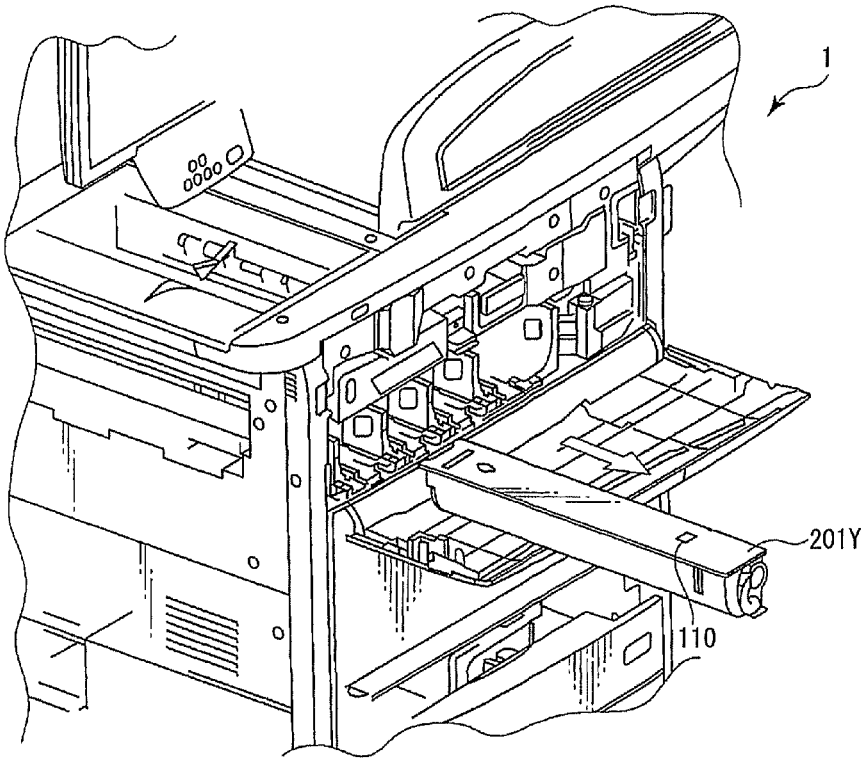
FIG. 2 is a partial schematic view of an image forming apparatus for illustrating a positional relationship of process (or toner) cartridges with the apparatus.
Figure 3:
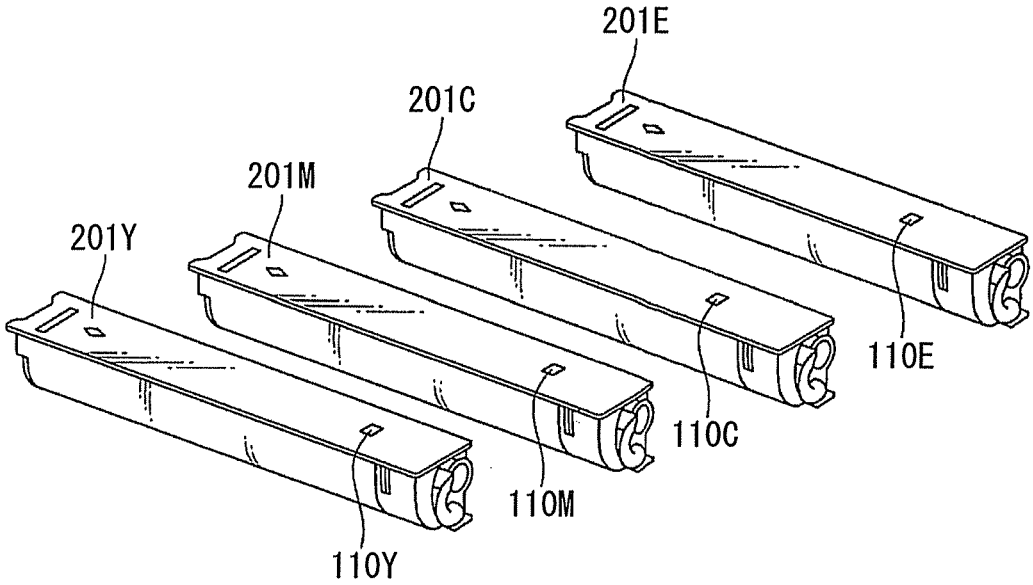
FIG. 3 is a schematic perspective view illustrating an arrangement of four color process (or toner) cartridges.

As shown in FIGS. 2 and 3, the color image forming apparatus 1 has toner cartridges 201Y, 201M, 201C, and 201E for supplying the toner of respective colors to the development devices 14Y, 14M, 14C, and 14E. The toner cartridges 201Y, 201M, 201C, and 201E are detachably mounted to the image forming apparatus 1. In order to achieve right matching with the development apparatus 14Y, 14M, 14C, and 14E, IC chips 110Y, 110M, 110C, and 110E having memorized each color information of the developers are provided to the toner cartridges of respective colors.

Figure 4:
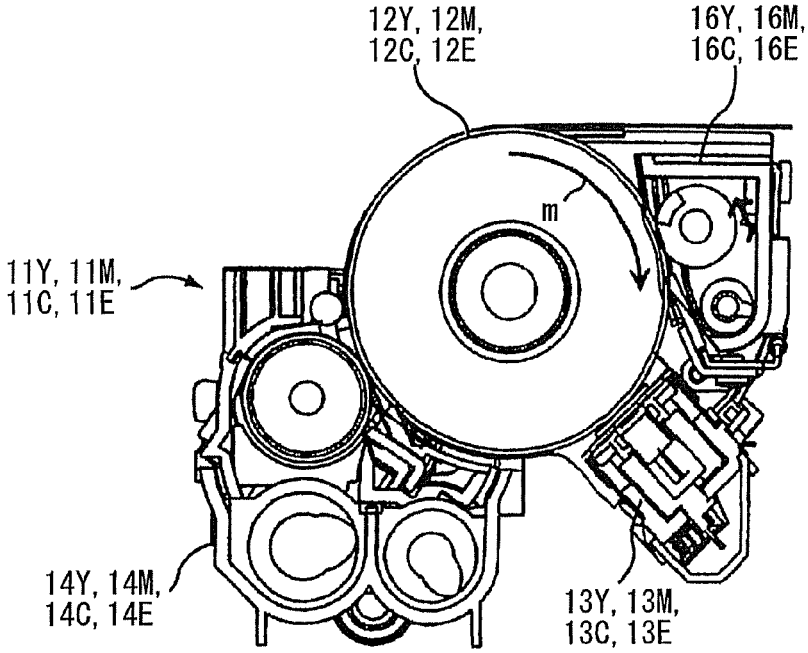
FIG. 4 is a sectional view illustrating a structure of a process unit (cartridge) including several process devices to be disposed surrounding a photosensitive drum.

FIG. 4 is a sectional view of the image forming sections 11Y, 11M, 11C, and 11E. If the image forming section 11E is taken for example, it is composed as a process unit (cartridge) including a photosensitive drum 12E, an electrification charger 13E, a developing device 14E, and a cleaning device 16E, combined integrally. The image forming sections 11Y, 11M, and 11C are also in similar structures.

Figure 5:
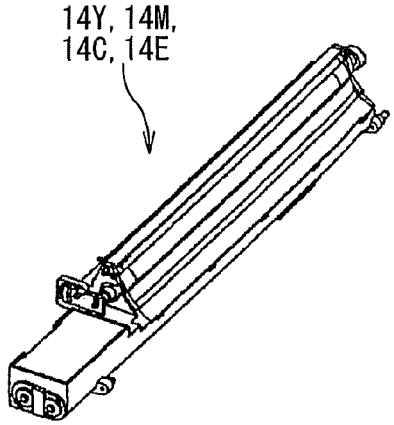
FIG. 5 is a perspective view of a process unit (cartridge) including only a developing device.

Incidentally, although FIG. 4 illustrates process units each including all the process means (devices) around the photosensitive drum are integrated, it is also possible to compose a developer cartridge including only a developing device 14Y, 14M, 14C, or 14E which is detachably mountable to a color image forming apparatus (MFP) 1 as shown in FIG. 5

While certain embodiments have been described, these embodiments have been presented by way of example only, and are not intended to limit the scope of the inventions. Indeed the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decolorable toner comprising:

toner particles comprising a binder resin having a carboxyl group, a microencapsulated color material comprising a color-forming compound, a color-developing agent and a decoloring agent; and a crosslink coating disposed on the toner particles said crosslink coating comprising a compound having a carbodiimide group or an epoxy group, wherein such compound is reactive with the carboxyl group of the binder resin.

2. The toner according to claim 1, wherein the toner particles each comprise an aggregate of particles, said aggregate further comprising particles of the microencapsulated color material and of the binder resin.

3. The toner according to claim 1, wherein the binder resin having a carboxyl group is a polyester-based resin or a styrene-acrylic resin.

4. A process for production of a decolorable toner, comprising:

aggregating dispersed particles of a microencapsulated color material comprising at least a color-forming compound, a color-developing agent and a decoloring agent with dispersed fine particles comprising at least a binder resin having a carboxyl group to form aggregate particles in an aqueous medium, adding a compound having a carbodiimide group or an epoxy group reactive with the carboxyl group of the binder resin into the aqueous medium to surface-treat the aggregate particles with the compound, and fusing the aggregate particles in the aqueous medium.

5. The process according to claim 4, wherein after forming the aggregate particles, the aggregate particles are encapsulated by adding a dispersion of particles comprising at least a binder resin having a carboxyl group to have the particles adhere to the aggregate particles, thereby coating the aggregate particles therewith.

6. The process according to claim 4, wherein the formation of the aggregate particles is performed at a temperature lower than the decolorized temperature of the color material particles.

7. A decolorable toner comprising aggregate particles, wherein each aggregate particle further comprises particles of a polyester binder resin, and particles of a microencapsulated color material, said microencapsulated color material further comprising a color-forming compound, a color-developing agent and a decoloring agent, wherein a surface region of the aggregate particles comprises a reactive compound having a carbodiimide group or an epoxy group.

8. The toner according to claim 7, wherein the surface region of the aggregate particles is composed only of a binder resin having a carboxyl group.

* * * * *